US006913159B1

(12) United States Patent
Goldberg

(10) Patent No.: US 6,913,159 B1
(45) Date of Patent: Jul. 5, 2005

(54) WATER BOTTLE STRAP WITH FINGER HOLES

(76) Inventor: Robert H. Goldberg, 2203 Third St., #11, Santa Monica, CA (US) 90405

( * ) Notice: Subject to any disclaimer, the term of this patent is extended or adjusted under 35 U.S.C. 154(b) by 82 days.

(21) Appl. No.: 10/386,048

(22) Filed: Mar. 10, 2003

(51) Int. Cl.[7] ..... B65D 23/10

(52) U.S. Cl. ..... 215/396; 215/395; 220/755; 220/758; 294/31.2; 294/33

(58) Field of Search ..... 215/395, 396, 215/398; 220/741, 742, 755, 758, 759; 294/31.2, 33, 27.1

(56) References Cited

U.S. PATENT DOCUMENTS

| | | | | | |
|---|---|---|---|---|---|
| 1,825,897 | A | | 10/1931 | Brooke | |
| D149,933 | S | | 6/1948 | Bushman | D58/26 |
| D160,567 | S | * | 10/1950 | Wylie | D7/536 |
| 2,524,639 | A | | 10/1950 | Saunders | 224/26 |
| 2,981,562 | A | * | 4/1961 | Long | 294/31.2 |
| 3,116,947 | A | | 1/1964 | Brownrigg | 294/31.2 |
| 3,799,600 | A | | 3/1974 | Chappell | 294/31.2 |
| 4,379,578 | A | | 4/1983 | Schuler | 294/31.2 |
| 4,552,396 | A | * | 11/1985 | Rais | 294/27.1 |
| 4,627,546 | A | | 12/1986 | Carranza | 215/100 |
| 4,660,876 | A | * | 4/1987 | Weldin et al. | 294/33 |
| 4,666,197 | A | * | 5/1987 | Watson et al. | 294/31.2 |
| 4,667,359 | A | | 5/1987 | Polotti | 7/151 |
| 4,723,801 | A | | 2/1988 | Musumeci et al. | 294/33 |
| 4,724,971 | A | | 2/1988 | Henline | 215/100 |
| 4,967,918 | A | * | 11/1990 | Long | 215/385 |
| 4,972,964 | A | | 11/1990 | Escalante | 220/94 |
| 5,054,638 | A | * | 10/1991 | Rose | 220/759 |
| 5,086,937 | A | * | 2/1992 | Robinson | 215/398 |
| 5,183,169 | A | | 2/1993 | Grzych | 215/100 |
| D343,094 | S | * | 1/1994 | Varney | D7/622 |
| D350,879 | S | | 9/1994 | Gelston | D7/622 |
| D357,387 | S | | 4/1995 | Davidson | D7/622 |
| 5,413,231 | A | * | 5/1995 | Carroll et al. | 215/396 |
| 5,609,175 | A | * | 3/1997 | Gerry et al. | 135/16 |
| D397,940 | S | * | 9/1998 | Safarian | D7/622 |
| 5,938,256 | A | | 8/1999 | Lovette | 294/87.2 |
| D440,496 | S | | 4/2001 | Adam et al. | D9/455 |
| D478,509 | S | * | 8/2003 | DeCotis | D9/455 |

FOREIGN PATENT DOCUMENTS

| | | | | |
|---|---|---|---|---|
| EP | 0524328 A1 | * | 1/1993 | |
| EP | 0652158 A1 | | 5/1995 | B65D/23/10 |
| GB | 2128878 A | * | 5/1984 | A47J/45/07 |

* cited by examiner

*Primary Examiner*—Sue A. Weaver
(74) *Attorney, Agent, or Firm*—Andrew S. Jordan, Esq.; Cislo & Thomas LLP

(57) ABSTRACT

A water bottle strap provides a manual engagement means for bottles or the like. A handle is defined from a substrate defining holes through which fingers or other digits may pass. The handle is held in tension along the side of the bottle by a top loop engaging the neck of the bottle and a base loop engaging the base of the bottle. The top loop and base loop are connected to the handle by means of upper and lower connecting segments, respectively. Each strap is generally made of flexible and resiliently stretchable material so as to snugly engage the water bottle in tension. A variety of materials can be used to provide an attractive or noticeable appearance as a bottle decoration as well as providing advantageous manual engagement means. Indicia or the like may be etched, written or engraved on the strap which may provide alternative grasping means by finger depressions separated by ridges defined along the outside of the handle.

23 Claims, 2 Drawing Sheets

FIG. 1
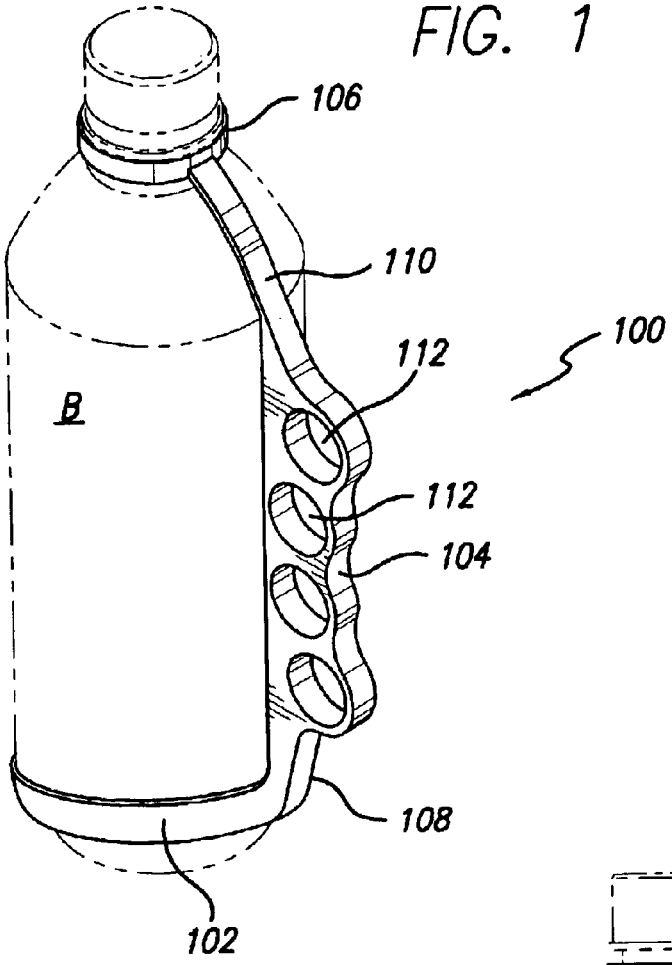
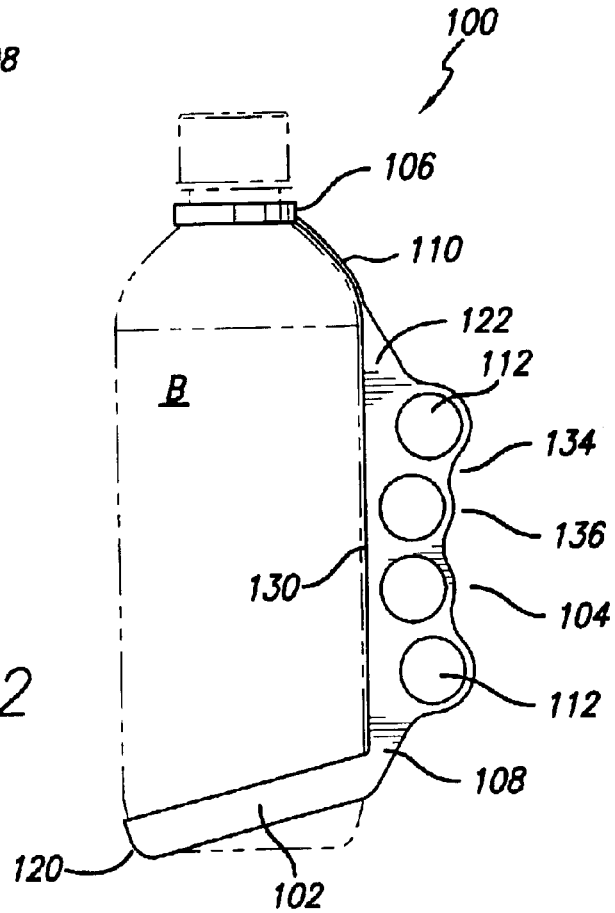
FIG. 2

WATER BOTTLE STRAP WITH FINGER HOLES

BACKGROUND OF THE INVENTION

1. Field of the Invention

This invention relates to human hydration devices and more particularly to a water bottle strap having finger holes, the water bottle strap engaging a water bottle at its neck and base.

2. Description of the Related Art

Over the past several years, municipal water supplies have decreased in quality. Additionally, especially in places like Southern California, foreign chemicals such as MTBE and perchlorates have entered into the water table.

Consequently, a number of people choose to drink bottled water in order to ensure that the water that they drink is of good quality. Additionally, individuals may choose to drink from water bottles as they need a portable source of water such as when they are jogging, working out, and the like. Carrying a water bottle, or two, can serve not only as a spontaneous hydration source, but also as a source of additional weight against which an exercising person may work.

While certain water bottles may provide a shape or surface that is easily grasped, generally, water bottles are cylindrical in shape having a base (sometimes tapered) and a threaded neck that engages, a screw top cap. Under certain circumstances, the water bottle may be difficult to engage or require a holder of some sort that provides means by which the water bottle may be grasped, carried, or attached to a third item.

As a novelty, water bottle holders are sometimes sold that enable a person to carry a water bottle over his or her shoulder. Certain other devices may also be present in the art that enable persons to carry water bottles manually, in conjunction with backpacks, book bags or the like, or enable individuals to better handle a water bottle when exercising or working out.

The following patents are known in the art.

| PATENT NUMBER | INVENTOR | DATE OF ISSUE |
|---|---|---|
| Des. 440,496 S | Adam et al. | Apr. 17, 2001 |
| 5,938,256 | Lovette | Aug. 17, 1999 |
| EP0652158 | Zaehner et al. | May 10, 1995 |
| Des. 357,387 | Davidson et al. | Apr. 18, 1995 |
| Des. 350,879 | Gelston | Sep. 27, 1994 |
| 5,183,169 | Grzych | Feb. 2, 1993 |
| 4,972,964 | Escalante | Nov. 27, 1990 |
| 4,724,971 | Henline | Feb. 16, 1988 |
| 4,723,801 | Musumeci et al. | Feb. 9, 1988 |
| 4,667,359 | Polotti | May 26, 1987 |
| 4,627,546 | Carranza | Dec. 9, 1986 |
| 4,552,396 | Rais | Nov. 12, 1985 |
| 4,379,578 | Schuler | Apr. 12, 1983 |
| 3,799,600 | Chappell | Mar. 26, 1974 |
| 3,116,947 | Brownrigg | Jan. 7, 1964 |
| 2,524,639 | Saunders | Oct. 3, 1950 |
| Des. 149,933 | Bushman | June 15, 1948 |
| 1,825,897 | Brooke | Oct. 6, 1931 |

In the Carranza '546 patent, a flexible detachable carrying handle for a plastic bottle is set forth, wherein the handle has a plurality of finger grips. This is particularly indicated in FIG. 1, elements 2, 2*b*, and 2*c*. In the Rais '396 patent, a plastic bottle handle having a hand grip loop is disclosed as shown in FIGS. 1 and 2, element 44. In the Chappell '600 and Lovette '256 patents, both disclose a bottle holder and carrier apparatus made of flexible material.

In the Musumeci '801 patent, a clip on bottle holder having a handle member and integral finger grip formations is shown in FIG. 2, elements 14 and 16.

U.S. Pat. Nos. 4,724,971; 4,379,578; 1,825,897; and 4,667,359 all disclose bottle carrying devices having a small upper loop which connects around the neck and a larger lower loop which connects to the base of the bottle. The Brownrigg '947 and Saunders '639 patents each disclose cylindrical container carriers having two circular bands used to fit around the primary object. The Grzych '169 and Escalante '964 patents both disclose bottle handles having an integrated closed base and an upper attachment means.

U.S. design patents Des. 357,387, Des. 440,496, Des. 350,879, and Des. 149,933 all disclose water bottle straps or handles that relate to or are associated with bottle containers. European Patent Application EP0652158 discloses a bottle holding handle having hand or other receiving openings as shown in FIG. 1, elements 29 and 30.

As can be seen, the relevant art area is generally crowded with respect to water bottle carriers, holders, and slings. A wide variety of different accommodating devices have been developed with respect to the carrying, holding, and/or accompanying water bottles, beverage bottles and liquid bottles. This includes the types of plastic bottles often seen in one and two liter volumes readily available on market shelves in the United States. In prior water bottle holders and handles, no individual loops or apertures for a person's fingers are present as the emphasis has always been previously on manual, as opposed to digital, engagement of the holder or handle. Manual engagement generally provides an advantage to pouring from the bottle, but not gripping it for extended periods and/or drinking from the bottle. Neither are there efficient ways by which the bottle may be grasped and secured in order to keep it from slipping from the hand with prior designs generally meant to accommodate the whole hand and not individual fingers. Additionally, there may be difficulties in placing the handles or holders around the bottle in a manner that is efficient, quick, and easy. Additionally, materials used for such bottle holders and handles may require significant cost, making such water bottle handles or holders less advantageous than those that might be less expensive.

SUMMARY OF THE INVENTION

In view of the foregoing disadvantages inherent in the known types of water bottle holders and handles now present in the prior art, the present invention provides a new water bottle handle design and construction that enables the quick and easy engagement of the water bottle by the strap. Additionally, fingers holes are present that allow the water bottle to be grasped with the hand either by surrounding the bottle or by just engaging the finger holes. The present invention provides a new water bottle strap design and construction wherein the user can easily grasp and maintain hold of an engaged bottle although his or her grip might slip, as well as a water bottle strap construction and design that can be achieved using inexpensive materials.

The general purpose of the present invention, which will be described subsequently in greater detail, is to provide a new water bottle strap having finger holes that easily engages a water or hydration bottle which has many of the advantages of the water bottles holders and handles mentioned and achieved heretofore as well as many novel features that result in a new water bottle strap that is not anticipated, rendered obvious, suggested, taught, or even implied by any of the prior art water bottle handles or holders either alone or in any combination thereof.

The water bottle strap of the present invention has a base loop for engaging the base of a water bottle. As used herein, the term water bottle means any container so engaged by the water bottle strap of the present invention. Connected to and generally traveling parallel along the side generally vertical height of the bottle (or a portion thereof) is a substrate defining finger hole apertures through which fingers may pass. Four finger holes are generally provided, one for each non-thumb digit of a person's hand. The water bottle strap may be used by right- or left-handed persons with equal ease. The top of the water bottle strap that engages the neck of the bottle does so below the threaded area engaged by the screw top cap or otherwise. The water bottle strap is constructed so as to undergo tension when it engages the water bottle may be constructed so as to provide snug engagement and to hold the finger hole substrate against the water bottle and consequently to prevent slippage of the water bottle strap as a whole.

OBJECTS OF THE INVENTION

It is an object of the present invention to provide a water bottle strap that allows easy manual engagement of a water bottle.

It is another object of the present invention to provide a water bottle strap that easily engages a water bottle.

It is another object of the present invention to provide a water bottle strap that provides a number of apertures or holes for digital engagement by a person's hand.

It is another object of the present invention to provide a water bottle strap that is constructed out of easily obtained and generally inexpensive materials.

It is another object of the present invention to provide a water bottle strap that can provide indicia for advertising, notices, or the like.

It is another object of the present invention to provide a water bottle handle that enhances the fun, glamour or attractiveness of a water or hydration container.

These and other objects and advantages of the present invention will be apparent from a review of the following specification and accompanying drawings. The foregoing objects are some of but a few of the goals attained by the present invention.

BRIEF DESCRIPTION OF THE DRAWINGS

FIG. 1 is a top side perspective view of the water bottle strap of the present invention. The water bottle strap is shown engaging a bottle that is shown in phantom.

FIG. 2 is a left side elevational view of a water bottle strap of FIG. 1 with the water bottle shown in phantom.

DESCRIPTION OF THE PREFERRED EMBODIMENT(S)

Figure 3:
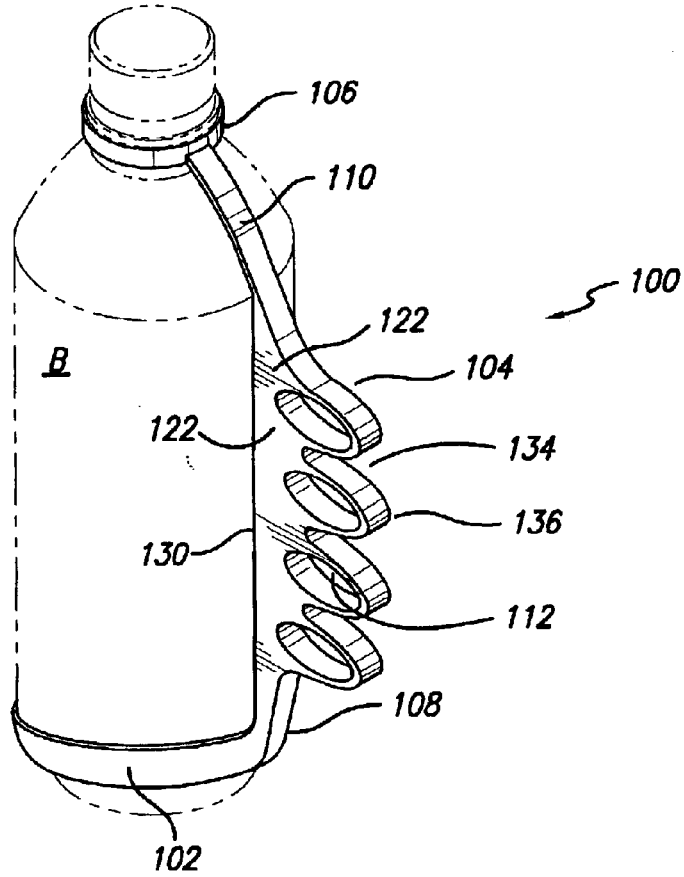
FIG. 3 is a top side perspective view of an alternative embodiment of the water bottle strap of the present invention having elongated finger/digit holes. The water bottle strap is shown engaging a bottle that is shown in phantom.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Referring to the drawings where like numerals of reference designate like elements throughout it will be noted that the water bottle strap 100 of the present invention has a base loop 102, a handle 104 and a top loop 106. The base loop 102 is connected to the handle 104 by a lower connecting segment 108. The handle 104 is connected to the top loop by an upper connecting segment 110.

Note should be taken that the water bottle strap 100 should have a handle 104 conforming to the dimensions of a human hand. However, the base loop 102, lower connecting segment 108, upper connecting segment 110, and the top loop 106 are configured to engage a bottle of a certain size. Consequently, these last elements that are not related directly to the human hand, but instead to the dimensions of the bottle, are variable according to the bottle to be engaged by the water bottle strap 100. The base loop 102 can be of any diameter to match that of the pertinent bottle as is also true for the top loop 106. The diameters and/or circumferences of each of the top 106 and base 102 loops are preferably such that snug engagement is achieved.

The handle 104 provides a substrate which defines finger or digit apertures 112 through which fingers may pass in order to engage the handle 104.

The base loop 102 generally engages the base of the bottle B in order to secure the lower part of the handle 104 to the bottle B via the lower connecting segment 108. As shown in FIG. 2, the base loop 102 may engage the base of the bottle B at an angle so that when the base loop 102 is applied to the base of the bottle B the handle 104 is placed in tension with respect to the top loop 106.

This is in distinction to a base loop 102 which, as an alternative embodiment, could engage the bottle B in a fashion perpendicular to the main axis of the bottle B. The sloped or slanted version of the base loop 102 is currently considered to be a preferable embodiment as it enables the handle 104 to be placed in tension with respect to the top and the bottom of bottle B therefore securing the handle 104 better in its engagement and disposition with respect to the water bottle B. However, other angular dispositions or geometries may be achievable that do not depart from the scope of the present water bottle strap invention. These include engagement of the portion of the bottle B by the base loop 102 at a point above the base of the bottle B. For example, the distal end 120 of the base loop 102 could be disposed above the base of the bottle B while still applying tension to hold the handle 104 in place or otherwise. Generally such tension is significant so that the handle 104 is held in place and does not ride upwardly due to its lower fixed point via the base loop 102 nor does the handle 104 right downwardly due to its fixed point arising from the top loop 106.

The lower connecting segment 108 may be of any distance, including a zero distance (if the handle 104 is directly connected to the base loop 102) to dispose the handle 104 advantageously with respect to the bottle B for easy manual engagement by a person's hand. Consequently, the lower connecting segment 108 may be long or short depending upon the bottle B, its height, circumference or shape, among other considerations.

The same is similarly true for the upper connecting segment 110 which may be of length, including zero length, to dispose the handle 104 propitiously with respect to the bottle B for easy manual engagement or otherwise. The lower and upper connecting segments 108, 110 may be intentionally stretchable and serve to provide the tension upon the handle 104. Consequently, the length, breadth, width, and/or thickness of the connecting segments 108, 110 may be such that they enable tension to be applied to the handle 104 when the bottle B is engaged by the strap 100. In a preferred embodiment, the connecting segments 108, 110 are durably flexible and resilient so that a number of different bottles B (generally the same size) may be engaged by the strap 100 over a length of a useful life of the strap 100. Alternatively, the strap 100 may be designed for temporary or disposable use such that a single bottle B is best engaged by the strap 100 although that bottle may be refilled several times with water or other replenishing fluid or otherwise. The handle 104 may generally be of the same thickness as the connecting segments 108, 110. The same may be similarly true for the base and top loops 102, 106. As shown in the drawings, the handle 104 has four holes through which the fingers or digits of a person's hand may pass through the handle 104. Fewer holes, including a single hole, may be used for the handle 104. However, the currently preferred embodiment has four finger holes 112 set forth in the handle substrate 122 by which the handle 104 may be achieved.

The finger holes 112 are disposed along the substrate 122 in a manner to enable easy or advantageous engagement of the handle 104 by a hand. Consequently, the relative geometry between the one or more finger holes 112 may be such that they are placed near the center of gravity when the bottle is full. Alternatively, the holes may be slightly convexedly arched with respect to the side of the bottle B as shown particularly in FIG. 2. The holes may also be linear to one another or concavedly disposed, randomly disposed, zigzagedly disposed, or otherwise as fancy or utility would indicate.

The strap 100 may be engaged by the hand engaging the bottle B with the fingers passing through the finger holes on one side of the bottle B with the opposable thumb being on the opposite side of the bottle B. Alternatively, the strap 100 may be used as a handle with the hand not engaging the bottle B and the fingers passing through the handle 104 via the finger holes in order to support the bottle much as a coffee cup handle provides manual engagement of a coffee cup.

The side of the handle 104 nearest the bottle 130 may conform to the shape of the bottle B. As shown in the figures, the bottle B is generally cylindrical in shape and the side of the bottle B is generally linear. However, other bottle shapes may be engaged by the handle side 130 of the handle 104 in a manner to provide a constructive engagement by the handle 104 with the bottle B. The side 132 of the handle 104 disposed opposite that of the bottle side 130 may have a variety of different geometry or shapes. Such geometry or shapes may include depressions 134 separated by gently or markedly rising ridges 136. The finger depressions 134 and separating ridges 136 may also provide a separate means by which the water bottle strap 100 provides a manual engagement means for the bottle B. For example, instead of curling one's fingers through the finger holes 112 the fingers could curl about the handle 104 in each of the finger depressions 134 with the thumb on the opposite side of the bottle.

A top loop 106 generally engages the neck of the bottle B. In many water bottles B, a screw cap is present that threadably engages the top of the bottle B. A flange or ring may circumscribe the lower end of the threaded bottle section and serve to stop the downward travel of the screw cap as well as providing a relatively secure seal for the bottle B by the screw cap. The top loop 106 may stretchably, flexibly, or otherwise travel past this flange in order to engage the bottle B below the flange and maintain the sealing or travel-restricting function of the flange for the screw cap.

The water strap 100 may be made of readily-available and generally inexpensive material such as recyclable plastic or the like. Tensioning considerations indicate the use of a stretchable or flexible material, and the plastic material used to hold six-packs together (neck rings engaging six aluminum or other cans in a two by three arrangement) may be one such material. The water bottle strap 100 may be colored or dyed to provide a very attractive and noticeable decoration to the bottle B. Additionally, advertising, indicia, notices, or the like can be incorporated, etched or written upon the strap 100 in order to provide additional utility.

Figure 4:
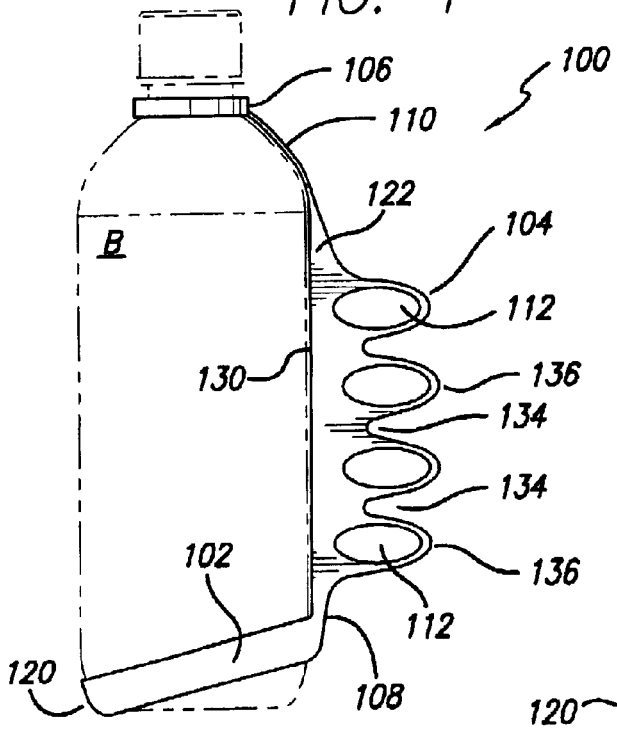
FIG. 4 is a left side elevational view of a water bottle strap of FIG. 3 with the water bottle shown in phantom.

FIGS. 3 and 4 show an alternative embodiment of the present invention having elongated finger holes 112 that create extended ridges 136. Between the ridges, in the interstitial space between the finger holes 112 are depressions 134 which can be engaged by fingers when a hand is wrapped around the bottle B and the strap 100.

Figure 5:
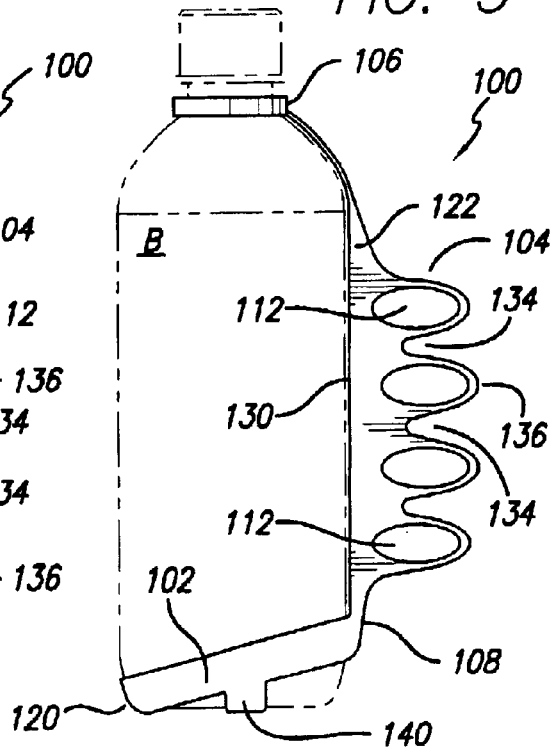
FIG. 5 is a left side elevational view of an alternative embodiment of the water bottle strap of FIG. 4 having a bottom strap with the water bottle shown in phantom.

FIG. 5 shows another alternative embodiment of the water bottle strap 100 of FIGS. 3 and 4. In FIG. 5, a bottom strap 140 traverses across the bottom of the bottle B to provide better engagement of the lower portion of the bottle B by the strap 100. The bottom strap 140 is coupled or attached to the base loop 102 and serves to better entrap the base of the bottle B. The bottom strap 140 also may enable better tensioning of the strap 100 so that it engages the bottle B in a better and more stable fashion.

While the present invention has been described with regards to particular embodiments, it is recognized that additional variations of the present invention may be devised without departing from the inventive concept.

What is claimed is:

1. A water bottle strap for manual engagement of a bottle, comprising:

a resilient top loop adapted to snugly engage a neck of the bottle;

a handle coupled to said top loop, said handle having a resilient substrate defining a finger hole; and a resilient base loop coupled to said handle, said base loop adapted to engage a lower portion of the bottle and to thereby place said handle in tension between said top loop and said base loop; whereby the water bottle strap is adapted to provide manual engagement of the bottle by enabling a person to grasp or engage the bottle by passing one or more fingers through said handle.

2. A water bottle strap for manual engagement of a bottle as set forth in claim 1, wherein said top loop further comprises:

said top loop resiliently and stretchably expanding and contracting to snugly engage said neck.

3. A water bottle strap for manual engagement of a bottle as set forth in claim 1, wherein said handle further comprises:

said handle adapted to be disposed between a top of the bottle and a bottom of the bottle, said handle having a plurality of finger holes.

4. A water bottle strap for manual engagement of a bottle as set forth in claim 3, wherein said handle further comprises:

four finger holes.

5. A water bottle strap for manual engagement of a bottle as set forth in claim 3, wherein said handle further comprises:

an outside surface having ridges, said ridges defining depressions adapted to receive fingers.

6. A water bottle strap for manual engagement of a bottle as set forth in claim 5, wherein said handle further comprises:

elongated finger holes providing said ridges with interstitial space between said finger holes providing said depressions.

7. A water bottle strap for manual engagement of a bottle as set forth in claim 1, wherein said base loop further comprises:

said base loop resiliently and stretchably expanding and contracting to snugly engage said lower portion of the bottle.

8. A water bottle strap for manual engagement of a bottle as set forth in claim 7, wherein said base loop further comprises:

said base loop adapted to engage the bottle at an angle off a perpendicular to a main axis of the bottle.

9. A water bottle strap for manual engagement of a bottle as set forth in claim 8, wherein said base loop further comprises:

said angle enhancing tension along the water bottle strap to promote greater tension and snug engagement of the bottle by the water bottle strap.

10. A water bottle strap for manual engagement of a bottle as set forth in claim 7, wherein said base loop further comprises:

said base loop engaging a bottom portion of the bottle.

11. A water bottle strap for manual engagement of a bottle as set forth in claim 7, wherein said base loop further comprises:

a bottom strap coupled to said base loop, said bottom strap traversing a bottom of the bottle.

12. A water bottle strap for manual engagement of a bottle as set forth in claim 11, wherein said bottom strap better holds the water bottle strap to the bottle.

13. A water bottle strap for manual engagement of a bottle as set forth in claim 1, further comprising:

an upper connecting segment coupling said top loop and said handle.

14. A water bottle strap for manual engagement of a bottle as set forth in claim 1, further comprising:

a lower connecting segment coupling said base loop and said handle.

15. A water bottle strap for manual engagement of a bottle as set forth in claim 1, further comprising:

the water bottle strap being made of plastic.

16. A water bottle strap for manual engagement of a bottle as set forth in claim 1, further comprising:

the water bottle strap being made of plastic that is colorable or dye-able and that is susceptible to engraving, etching, or writing so as to provide indicia or labeling.

17. A water bottle strap for manual engagement of a bottle, comprising:

a top loop adapted to resiliently engage a neck of the bottle, said top loop resiliently and stretchably expanding and contracting to snugly engage said neck;

an upper connecting segment coupled to said top loop;

a handle coupled to said upper connecting segment, said handle having a resilient substrate defining four finger holes, said handle having an outside surface having ridges, said ridges defining depressions adapted to receive fingers with said depressions aligned approximately in between said finger holes, said handle adapted to be disposed approximately midway between a top of the bottle and a bottom of the bottle;

a lower connecting segment coupled to said handle; and a resilient base loop coupled to said lower connecting segment, said base loop adapted to engage a lower portion of the bottle, said base loop resiliently and stretchably expanding and contracting to snugly engage said lower portion of the bottle and to thereby place said handle in tension between said top loop and said base loop along the exterior of the bottle, said base loop adapted to engage the bottle at an angle off a perpendicular to a main axis of the bottle; whereby the water bottle strap is adapted to provide manual engagement of the bottle by enabling a person to grasp or engage the bottle by passing one or more fingers through said handle.

18. A water bottle strap for manual engagement of a bottle as set forth in claim 17, wherein said base loop further comprises:

said angle enhancing tension along the water bottle strap to promote greater tension and snug engagement of the bottle by the water bottle strap.

19. A water bottle strap for manual engagement of a bottle as set forth in claim 17 wherein said base loop further comprises:

said base loop engaging a bottom portion of the bottle.

20. A water bottle strap for manual engagement of a bottle as set forth in claim 17, further comprising:

the water bottle strap being made of plastic.

21. A water bottle strap for manual engagement of a bottle as set forth in claim 17, further comprising:

the water bottle strap being made of plastic that is colorable or dye-able and that is susceptible to engraving, etching, or writing so as to provide indicia or labeling.

22. A water bottle strap for manual engagement of a bottle as set forth in claim 17, wherein said base loop further comprises:

a bottom strap coupled to said base loop, said bottom strap traversing a bottom of the bottle to better hold the water bottle strap to the bottle.

23. A water bottle strap for manual engagement of a bottle as set forth in claim 17, wherein said handle further comprises:

elongated finger holes providing said ridges with interstitial space between said finger holes providing said depressions.

* * * * *